US009985339B2

(12) United States Patent
Imamura

(10) Patent No.: US 9,985,339 B2
(45) Date of Patent: May 29, 2018

(54) LOW-PROFILE ANTENNA DEVICE

(71) Applicant: HARADA INDUSTRY CO., LTD., Tokyo (JP)

(72) Inventor: Yutaka Imamura, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 149 days.

(21) Appl. No.: 14/410,498

(22) PCT Filed: Jun. 26, 2013

(86) PCT No.: PCT/JP2013/067579
§ 371 (c)(1),
(2) Date: Dec. 22, 2014

(87) PCT Pub. No.: WO2014/003078
PCT Pub. Date: Jan. 3, 2014

(65) Prior Publication Data

US 2015/0349409 A1 Dec. 3, 2015

(30) Foreign Application Priority Data

Jun. 26, 2012 (JP) ..... 2012-142706

(51) Int. Cl.
*H01Q 1/32* (2006.01)
*H01Q 1/27* (2006.01)
(Continued)

(52) U.S. Cl.
CPC ..... *H01Q 1/27* (2013.01); *H01Q 1/3275* (2013.01); *H01Q 1/362* (2013.01); *H01Q 1/42* (2013.01); *H01Q 9/36* (2013.01); *H01Q 11/08* (2013.01)

(58) Field of Classification Search
CPC .... H01Q 1/1271; H01Q 1/3275; H01Q 1/325; H01Q 1/325
(Continued)

(56) References Cited

U.S. PATENT DOCUMENTS 6,362,784 B1 3/2002 Kane et al.
2002/0171593 A1 11/2002 Wakui et al.
(Continued)

FOREIGN PATENT DOCUMENTS

EP 0 989 629 A1 3/2000
JP 2000-77923 A 3/2000
(Continued)

OTHER PUBLICATIONS

International Search Report dated Sep. 17, 2013 issued in corresponding application No. PCT/JP2013/067579.

*Primary Examiner* — Dameon E Levi
*Assistant Examiner* — Collin Dawkins
(74) *Attorney, Agent, or Firm* — Westerman, Hattori, Daniels & Adrian, LLP

(57) ABSTRACT

Provided is a low-profile antenna device that allows the height of an antenna to be further reduced. The low-profile antenna device comprises a base section, a helical antenna section, and a top load section. The helical antenna section is wound along an oblique axial direction starting from the base section. The conductive top load section, which is electrically connected to the tip of the helical antenna section, has a top section that is provided on the opposite side to a vehicle, to which the antenna device is fixed, and side sections that are provided on the vehicle side in oblique directions from the top section such that no part of the helical antenna section is placed between the top load section and the vehicle in the direction of a perpendicular line formed therebetween.

11 Claims, 3 Drawing Sheets

(51) Int. Cl.

| | |
|---|---|
| ***H01Q 1/36*** | (2006.01) |
| ***H01Q 1/42*** | (2006.01) |
| ***H01Q 9/36*** | (2006.01) |
| ***H01Q 11/08*** | (2006.01) |

(58) Field of Classification Search
USPC ..... 343/713, 872, 725, 711, 712
See application file for complete search history.

(56) References Cited

U.S. PATENT DOCUMENTS

| | | | | |
|---|---|---|---|---|
| 2008/0117111 | A1* | 5/2008 | Ikeda | H01Q 1/1214<br>343/713 |
| 2009/0207084 | A1* | 8/2009 | Ikeda | H01Q 1/1207<br>343/713 |
| 2012/0326935 | A1* | 12/2012 | Kang | H01Q 1/3275<br>343/713 |

FOREIGN PATENT DOCUMENTS

| | | | |
|---|---|---|---|
| JP | 2000-156608 | A | 6/2000 |
| JP | 2002-84124 | A | 3/2002 |
| JP | 3095114 | U | 7/2003 |
| WO | 2007/097532 | A1 | 8/2007 |
| WO | 20008/062746 | A1 | 5/2008 |

* cited by examiner

LOW-PROFILE ANTENNA DEVICE

TECHNICAL FIELD

The present invention relates to a low-profile antenna device, and more particularly to a low-profile antenna device having a top load portion.

BACKGROUND ART

There is conventionally known an antenna device adaptive to two frequencies. An antenna device installed on a roof or the like of a vehicle is preferably installed at the highest position of the vehicle in terms of receiving sensitivity, while there is desired a low-profile antenna device in order to meet a height regulation and the like. Recently, a "lower-profile" antenna device, such as so-called a shark-fin type antenna device, in which the low-profile characteristic is further strengthened, is being developed.

As such a low-profile antenna device, there is known an antenna device provided with so-called a top load portion so as to perform satisfactory operation at the two frequencies. For example, Patent Document 1 discloses a technology in which an umbrella-shaped top load portion is provided at a leading end of an element portion installed upright from a base portion. This can reduce a length of the element portion to thereby realize a "lower-profile" antenna device.

CITATION LIST

Patent Document

[Patent Document 1] Japanese Patent Application Kokai Publication No. 2002-084124

DISCLOSURE OF THE INVENTION

Problems to be Solved by the Invention

However, it is difficult to apply the technology disclosed in Patent Document 1 to a lower-profile antenna device such as so-called a shark-fin type antenna device. When the length of the element portion is reduced, the sensitivity is deteriorated, so that the satisfactory operation cannot be expected.

The present invention has been made in view of the above situation, and an object thereof is to provide a low-profile antenna device that height can be reduced more.

Means for Solving the Problems

In order to achieve the above object of the present invention, a low-profile antenna device according to the present invention comprises: a base portion for being fixed to a vehicle; a helical antenna portion wound about an axis obliquely extending from the base portion; and a conductive top load portion electrically connected to a leading end of the helical antenna portion. The top load portion has an apex portion positioned on an opposite side to the vehicle to which the antenna device is fixed and side surface portions obliquely extends from the apex portion toward the vehicle. The top load portion is disposed such that the helical antenna portion is not interposed between the top load portion and the vehicle in a perpendicular direction.

The top load portion may further comprise a rear surface portion extending on a side opposite to a portion to which the helical antenna portion is connected.

The helical antenna portion may be configured not to extend up to an inside of the top load portion.

The low-profile antenna device may further comprise a support portion fixed to the base portion and supporting the helical antenna portion and/or the top load portion.

The low-profile antenna device may further comprise an antenna cover covering the base portion, the helical antenna portion, and the top load portion. The top load portion may be formed so as to match a shape of the antenna cover.

The top load portion may be provided to the antenna cover side.

The low-profile antenna device may further comprise a circuit portion placed on the base portion. The circuit portion may be configured not to be interposed between the top load portion and the vehicle in the perpendicular direction.

Advantages of the Invention

The low-profile antenna device according to the present invention allows further reduction in the antenna height.

BEST MODE FOR CARRYING OUT THE INVENTION

Figure 1:
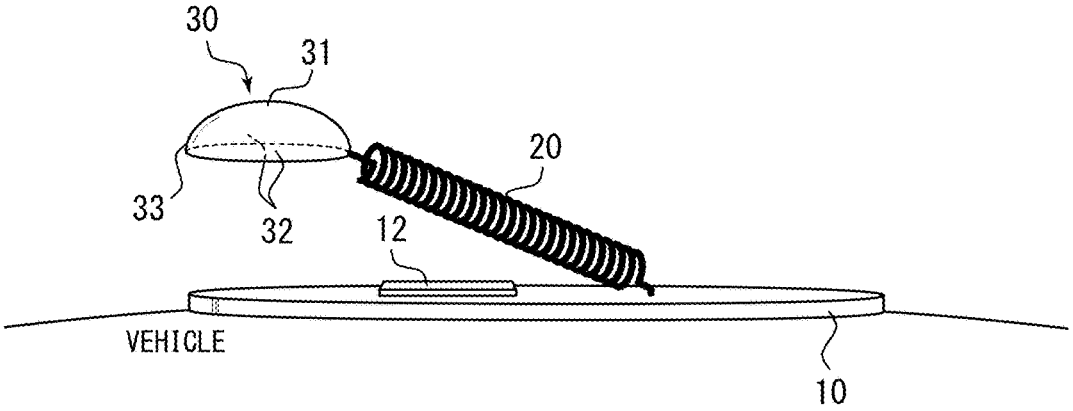
FIG. 1 is a schematic perspective view illustrating a low-profile antenna device according to the present invention.

An embodiment of the present invention will be described together with illustrated examples. FIG. 1 is a schematic perspective view illustrating a low-profile antenna device according to the present invention. As illustrated, the low-profile antenna device according to the present invention mainly includes a base portion 10, a helical antenna portion 20, and a top load portion 30.

The base portion 10 is fixed to a vehicle. The base portion 10 may be formed of an insulator such as resin or conductor such as metal. Further, a circuit portion 12 or the like may be placed on the base portion 10. The circuit portion 12 is, e.g., an amplifier circuit and is used for amplifying a reception signal.

The helical antenna portion 20 is wound about an axis obliquely extending from the base portion 10. For example, the helical antenna portion 20 mainly functions as an FM antenna. The helical antenna portion 20 may be wound with such a length that a target frequency is set to an FM frequency band together with the top load portion 30 to be described later. Extending obliquely from the base portion 10 means that extending obliquely from the vehicle to which the base portion 10 is fixed. The helical antenna portion 20 is not installed upright from the base portion 10 and may be provided in a obliquely state. In the low-profile antenna device according to the present invention, the helical antenna portion 20 is wound about the axis obliquely extending from the base portion 10 as described above, whereby it is possible to reduce antenna height while ensuring antenna length. The helical antenna portion 20 may be constructed by winding an element around a dielectric or insulating support rod or may use an air core, as a matter of course.

The conductive top load portion 30 which is the most characteristic part of the low-profile antenna device according to the present invention is electrically connected to a leading end of the helical antenna portion 20. For example, the top load portion 30 functions as an AM antenna. As illustrated in FIG. 1, the top load portion 30 has a hemispherical dome shape. The top load portion 30 only needs to have an apex portion 31 and side surface portions 32. The apex portion 31 is positioned over an opposite side to the vehicle to which the antenna device is fixed. The side surface portions 32 obliquely extend from the apex portion 31 toward the vehicle. When the top load portion 30 has a hemispherical dome shape as illustrated, it has a rear surface portion 33 in addition to the apex portion 31 and the side surface portions 32. The rear surface portion 33 extends on a side opposite to a portion to which the helical antenna portion 20 is connected. The above portions are combined to form the hemispherical dome shape. More specifically, the dome shape has an opening on a vehicle side to which the antenna device is fixed and an apex portion over a side opposite to the vehicle. In a front view of the antenna device, the top load portion 30 has a ridge shape in cross section, but not limited thereto. For example, it may have so-called a double-humped dome shape having two top potions. The top load portion 30 thus configured is disposed such that the helical antenna portion 20 is not interposed between the top load portion 30 and the vehicle in a perpendicular direction. That is, as viewed from above the low-profile antenna device, the helical antenna portion 20 does not overlap the top load portion 30 (top load portion 30 does not cover the helical antenna portion 20). The perpendicular direction from the top load portion 30 to the vehicle refers to a direction just below the top load portion 30. The perpendicular direction from the top load portion 30 to the vehicle has the same meaning as the perpendicular direction to the base portion 10 when the top load portion 30 is positioned above the base portion 10. However, there may be a case where, depending on a shark-fin type antenna, the top load portion 30 is disposed so as to protrude toward a rear side of the base portion 10. In such a case, the expression "the perpendicular direction to the vehicle" is more appropriate.

By thus preventing the helical antenna portion 20 from being located below the top load portion 30, it is possible to reduce mutual influence between the top load portion 30 and the helical antenna portion 20. In the present invention, the top load portion 30 only needs to be disposed such that the helical antenna portion 20 is not fully interposed between itself and the vehicle in a perpendicular direction, and the helical antenna portion 20 and the top load portion 30 may overlap each other as long as the mutual influence therebetween is ignorable.

Further, for example, when the circuit portion 12 is placed on the base portion 10, the circuit portion 12 is positioned so as not to be interposed between the top load portion 30 and the vehicle in the perpendicular direction. This can achieve further reduction in the antenna height while reducing influence to be exerted on the helical antenna portion 20 and the top load portion 30 and improving reception sensitivity characteristics.

In the low-profile antenna device according to the present invention, the use of the thus configured top load portion allows the helical antenna portion to be disposed obliquely with respect to the perpendicular direction, thereby allowing further reduction in the antenna height.

Figure 2:
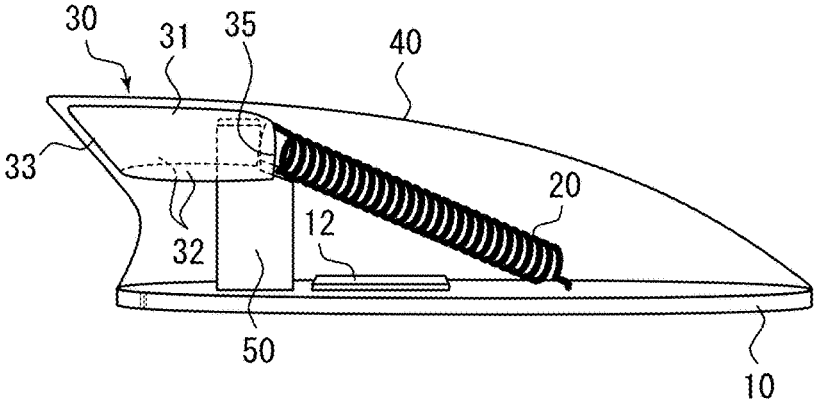
FIG. 2 is a schematic perspective view illustrating a modification of a top load portion of the low-profile antenna device according to the present invention.

In the above illustrated example, the top load portion has the hemispherical dome shape. However, the present invention is not limited thereto, but the top load portion only needs to have the apex portion and the side surface portions. FIG. 2 is a schematic perspective view illustrating a modification of the top load portion of the low-profile antenna device according to the present invention. In FIG. 2, parts designated by the same reference numerals as FIG. 1 are identical with those of FIG. 1. As illustrated, when the antenna device is actually installed on the vehicle, the base portion 10, the helical antenna portion 20, and the top load portion 30 are covered by an antenna cover 40. In the illustrated example, the antenna cover 40 is made transparent for descriptive convenience so as to allow an interior of the antenna cover 40 to be viewed. The top load portion 30 is formed so as to match a shape of the antenna cover 40. That is, the apex portion 31, the side surface portions 32, and the rear surface portion 33 are formed so as to match the shape of the shark-fin shaped antenna cover 40. FIG. 2 illustrates an example of the top load portion 30 having the rear surface portion 33. However, the present invention is not limited to this, and the top load portion 30 need not have the rear surface portion 33 and may have an opening at the corresponding portion. In a case where the rear surface portion 33 is formed obliquely with respect to the perpendicular direction as illustrated to increase an area of a surface opposite to the vehicle or base portion 10 under a condition where a distance between the rear surface portion 33 and the vehicle or the base portion 10 is small, a disabled capacitance may increase. In such a case, the rear surface portion need not be provided. Further, when a length obtained by adding the helical antenna portion 20 and the top load portion 30 needs to be increased, it becomes longer when the rear surface portion is provided. Thus, in such a case, the rear surface portion is provided. As described above, whether the rear surface portion is provided or not can be determined depending on requirements for the antenna device.

In this configuration, the helical antenna portion 20 is configured not to extend up to an inside of the top load portion 30, that is, an inside of the dome shape. Further, as illustrated, the top load portion 30 has a cut portion 35 on a surface thereof facing the helical antenna portion 20. In this case, the leading end of the helical antenna portion 20 is connected to the apex portion 31 of the cut portion 35 on the helical antenna portion 20 side.

As illustrated in FIG. 2, the helical antenna portion 20 and the top load portion 30 is supported by a support portion 50. The support portion 50 is fixed to the base portion 10 and is formed of an insulating material so as not to exert influence on, e.g., the top load portion 30. In the low-profile antenna device according to the present invention, the helical antenna portion 20 and the circuit portion 12 are not interposed between the top load portion 30 and the vehicle in the perpendicular direction, so that there is no object that exerts influence on the antenna portion at an area just below the top load portion 30. This allows the support portion 50 to be disposed in the illustrated space. The support portion 50 may be configured to support only the top load portion 30 or to support only the helical antenna portion 20. As a matter of course, the support portion 50 may be configured to support both the top load portion 30 and the helical antenna portion 20, as illustrated.

Figure 3:
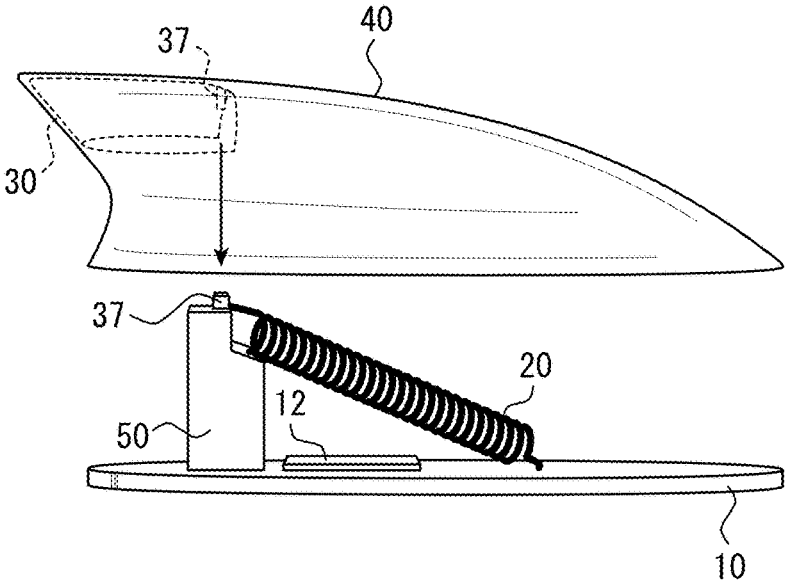
FIG. 3 is a schematic perspective view illustrating another modification of the top load portion of the low-profile antenna device according to the present invention.

Another modification of the top load portion of the low-profile antenna device according to the present invention will be described using FIG. 3. FIG. 3 is a schematic perspective view illustrating another modification of the top load portion of the low-profile antenna device according to the present invention. In FIG. 3, parts designated by the same reference numerals as FIG. 2 are identical with those of FIG. 2. In this example, the top load portion 30 is provided on the antenna cover 40 side. In this case, for example, in the course of forming the antenna cover 40, the top load portion 30 is embedded in a resin material constituting the antenna cover 40 by insert molding to be integrated with the antenna cover 40. Alternatively, the top load portion 30 may be attached to an inside of the antenna cover 40. Then, for example, an plug terminal 37 is provided at a connection portion between the top load portion 30 and the helical antenna portion 20. When the antenna cover 40 is fitted to the base portion 10 at assembly of the low-profile antenna device, the plug terminal 37 is electrically connected to the top load portion 30, thereby allowing connection between the top load portion 30 and the helical antenna portion 20 to be achieved.

Figure 4A:
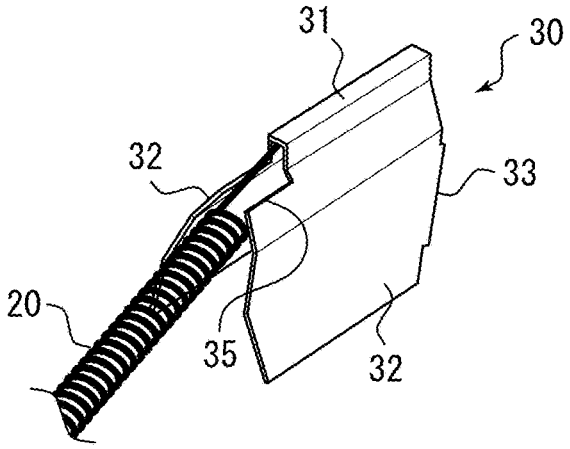
FIGS. 4A and 4B are schematic perspective views each illustrating still another modification of the top load portion of the low-profile antenna device according to the present invention.
Figure 4B:
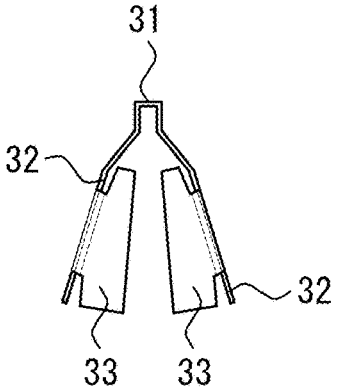

Still another modification of the top load portion of the low-profile antenna device according to the present invention will be described using FIGS. 4A and 4B. FIGS. 4A and 4B are schematic perspective views each illustrating still another modification of the top load portion of the low-profile antenna device according to the present invention. FIG. 4A is a schematic perspective view, and FIG. 4B is a rear view. In FIG. 4, parts designated by the same reference numerals as FIG. 2 are identical with those of FIG. 2. In FIGS. 4A and 4B, only the top load portion and the helical antenna portion are illustrated. As illustrated, the top load portion 30 of the low-profile antenna device according to the present invention has the apex portion 31, the side surface portions 32, and the rear surface portion 33. In the above-described examples, the side surface portion has a curved shape, while the side surface portion 32 in this example has a flat plate shape obliquely extending from the apex portion 31 toward the vehicle. Further, in a front view of the antenna device, the apex portion 31 of the top load portion 30 in this example has a substantially rectangular shape in cross section, and each of two side surface portions 32 is inclined in two stages in cross section. Further, the rear surface portion 33 is formed so as to extend from each side surface portion 32. Further, as illustrated, the rear surface portion 33 need not cover the entire rear surface of the top load portion 30. Further, as described above, the rear surface portion 33 may be omitted depending on a size of the opposing surface to the vehicle or base portion or a distance from the vehicle or base portion. In addition, the cut portion 35 extends up to the apex portion. The helical antenna portion 20 is electrically connected to the apex portion 31 of the cut portion 35 on the helical antenna portion 20 side. The top load portion 30 thus configured can be formed only by punching out a conductive plate into a predetermined shape and then bending the resultant plate, which is advantageous in processing of the top load portion.

Figure 5:
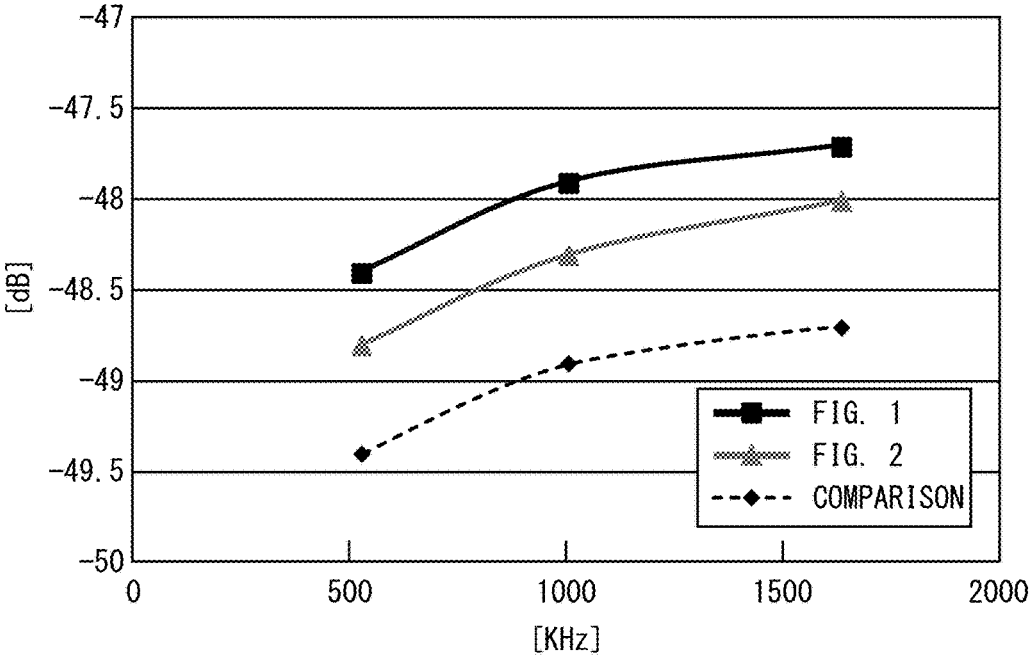
FIG. 5 is a graph illustrating reception sensitivity characteristics of the low-profile antenna device according to the present invention.

The following describes a variation in AM reception sensitivity characteristics due to a difference in shape of the top load portion of the low-profile antenna device according to the present invention. FIG. 5 is a graph illustrating reception sensitivity characteristics of the low-profile antenna device according to the present invention. In FIG. 5, a continuous black line represents reception sensitivity characteristics obtained when the top load portion is formed into the hemispherical shape as illustrated in FIG. 1, and a continuous gray line represents reception sensitivity characteristics obtained when the top load portion is modified as illustrated in FIG. 2. As a comparative example, a low-profile antenna device in which a pipe-shaped top load portion that opening does not face the vehicle side unlike the present invention but an axial direction thereof extends in a horizontal direction is connected to the leading end of the helical antenna portion was used. The AM reception sensitivity characteristics of the comparative example are represented by a dashed line.

As illustrated, it can be seen that the AM reception sensitivity characteristics are varied according to the shape of the top load portion. That is, the highest sensitivity is obtained when the top load portion is formed into the hemispherical shape as illustrated in FIG. 1, followed by the modification illustrated in FIG. 2. As described above, it can be seen that the low-profile antenna device according to the present invention exhibits high AM reception sensitivity characteristics even with a low antenna height.

Figure 6:
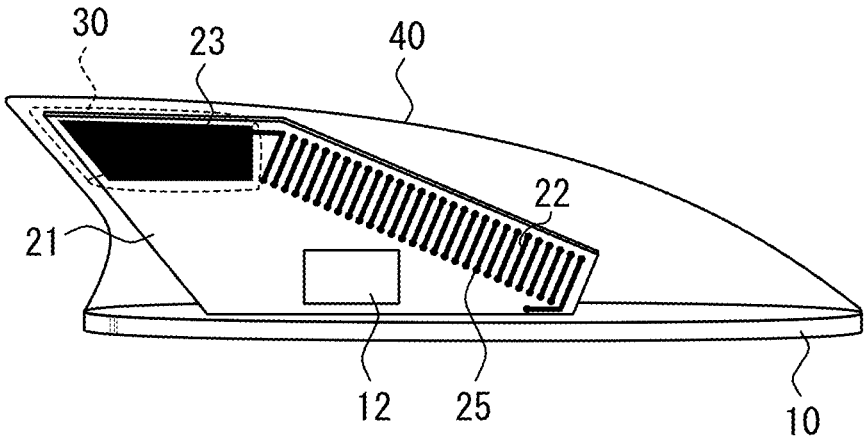
FIG. 6 is a schematic perspective view illustrating a modification of a helical antenna portion of the low-profile antenna device according to the present invention.

Next, a modification of the helical antenna portion of the low-profile antenna device according to the present invention will be described using FIG. 6. FIG. 6 is a schematic perspective view illustrating a modification of the helical antenna portion of the low-profile antenna device according to the present invention. In FIG. 6, parts designated by the same reference numerals as FIG. 2 are identical with those of FIG. 2. As illustrated, a low-profile antenna device of this example has an element substrate 21 provided perpendicularly with respect to the base portion 10. A helical antenna portion 22 is formed by a conductive pattern provided on the element substrate 21. The element substrate 21 is, e.g., a double-sided substrate. An element pattern corresponding to the helical antenna portion 22 is formed by etching a conductive thin film on the substrate. In the illustrated example, the element patterns formed on both sides are connected via through holes 25 to obtain a helical pattern.

When the circuit portion 12, such as an amplifier circuit, used for amplifying a reception signal is necessary, it can be provided on the element substrate 21 as illustrated. The circuit portion 12 need not necessarily be disposed on the element substrate 21 but may be disposed on a circuit board different from the element substrate 21. The circuit board may be provided perpendicularly with respect to the base portion 10 like the element substrate 21 or may be provided horizontally, i.e., parallel to the base portion 10. In a case where the circuit board is provided perpendicularly, it may be provided at the same surface as the element substrate or may be provided at a free space different from the element substrate in a horizontal direction. In a case where the circuit board is provided horizontally, it may be disposed at, e.g., a space forward of the helical antenna portion 22. Preferably, the circuit portion 12 is not interposed between the top load portion 30 and the vehicle in the perpendicular direction. This can reduce influence to be exerted by the circuit portion 12.

In the low-profile antenna device of the illustrated example, an opposing area between the circuit portion and the helical antenna portion is substantially smaller than that in the example of FIG. 2. Therefore, it can be considered that influence to be exerted from the circuit portion serving as a noise source on the helical antenna portion is reduced.

Further, as illustrated, the top load portion 30 is fixed to the element substrate 21. That is, in place of the support portion 50 illustrated in FIG. 2 and the like, the element substrate 21 is used, and the top load portion 30 is fixed to the element substrate 21 by means of a clip or welding. Further, a capacitance-adding conductive pattern 23 may be provided at a position on the element substrate where the side surface portion of the top load portion 30 overlaps. That is, as illustrated, the capacitance-adding pattern 23 may be provided at a position covered by the top load portion 30. Specifically, the capacitance-adding pattern 23 may be a solid pattern or a mesh pattern. With this configuration, it is possible to additionally add electrostatic capacitance to the top load portion 30.

The capacitance-adding pattern 23 need not necessarily be provided at a position on the element substrate where the side surface portion of the top load portion 30 overlaps. For example, the capacitance-adding pattern 23 may be shifted downward in a side view from the position where the side surface portion of the top load portion 30 overlaps. Further, the capacitance-adding pattern 23 may be shifted further downward to a position close to and below a lower edge of the side surface portions of the top load portion 30. Alternatively, the element substrate 21 may be made to extend upward from a top edge of the top load portion 30, so that the capacitance-adding pattern 23 may be shifted upward from the position where the side surface portion of the top load portion 30 overlaps. Further, the capacitance-adding pattern 23 may be shifted further upward to a position close to and above the top edge of the top load portion 30.

The low-profile antenna device according to the present invention is not limited to the above-described illustrated examples, but may be variously modified without departing from the scope of the present invention.

REFERENCE SIGNS LIST

10: Base portion
12: Circuit portion
20: Helical antenna portion
21: Element substrate
22: Helical antenna portion
23: Capacitance-adding pattern
25: Through hole
30: Top load portion
31: Apex portion
32: Side surface portion
33: Rear surface portion
35: Cut portion
37: Plug terminal
40: Antenna cover
50: Support portion

What is claimed is:

1. A low-profile antenna device comprising:

a base portion for being fixed to a vehicle;

a helical antenna portion wound about an axis obliquely extending from the base portion; and a conductive top load portion electrically connected to a leading end of the helical antenna portion, the conductive top load portion having an apex portion positioned on an opposite side to the vehicle to which the antenna device is fixed and side surface portions obliquely extend from the apex portion toward the vehicle, being disposed such that the helical antenna portion does not overlap the conductive top load portion as viewed from above of the low profile antenna device, and the conductive top load portion does not overlap the helical antenna portion as viewed from above of the low profile antenna device.

2. The low-profile antenna device according to claim 1, in which the conductive top load portion further comprises a rear surface portion extending on a side opposite to a portion to which the helical antenna portion is connected.

3. The low-profile antenna device according to claim 1, in which the helical antenna portion does not extend up to an inside of the conductive top load portion.

4. The low-profile antenna device according to claim 1, which further comprises a support portion fixed to the base portion and supporting the helical antenna portion or the conductive top load portion.

5. The low-profile antenna device according to claim 1, which further comprises an antenna cover covering the base portion, the helical antenna portion, and the conductive top load portion, wherein the conductive top load portion is formed so as to match a shape of the antenna cover.

6. The low-profile antenna device according to claim 5, in which the conductive top load portion is provided on the antenna cover side.

7. The low-profile antenna device according to claim 1, which further comprises a circuit portion placed on the base portion, the circuit portion not being interposed between the conductive top load portion and the vehicle in the perpendicular direction.

8. The low-profile antenna device according to claim 1, which further comprises an element substrate provided perpendicularly with respect to the base portion, wherein the helical antenna portion is formed by a conductive pattern provided on the element substrate.

9. The low-profile antenna device according to claim 8, which further comprises a circuit portion disposed on the element substrate or a circuit board different from the element substrate, the circuit board being provided perpendicularly with respect to the base portion or horizontally, parallel to the base portion.

10. The low-profile antenna device according to claim 9, in which the circuit portion is not interposed between the conductive top load portion and the vehicle in the perpendicular direction.

11. The low-profile antenna device according to claim 8, in which the conductive top load portion is fixed to the element substrate, and a capacitance-adding conductive pattern is provided at a position on the element substrate where the side surface portion of the conductive top load portion overlaps.

* * * * *